United States Patent [19]

Druffel

[11] 4,279,210

[45] Jul. 21, 1981

[54] LOOPER THREAD TENSION DEVICE

[75] Inventor: Erich Druffel, Bielefeld, Fed. Rep. of Germany

[73] Assignee: Dürkoppwerke GmbH, Bielefeld, Fed. Rep. of Germany

[21] Appl. No.: 51,159

[22] Filed: Jun. 22, 1979

[30] Foreign Application Priority Data

Jun. 24, 1978 [DE] Fed. Rep. of Germany ..... 2827832

[51] Int. Cl.[3] ..... D05B 57/14

[52] U.S. Cl. ..... 112/181

[58] Field of Search ..... 112/181, 229

[56] References Cited

U.S. PATENT DOCUMENTS 1,461,428 9/1919 McCann .

2,178,544 11/1939 Rubel ..... 112/181

FOREIGN PATENT DOCUMENTS 739559 9/1943 Fed. Rep. of Germany .

2741830 3/1979 Fed. Rep. of Germany .

336504 12/1905 France .

*Primary Examiner*—Werner H. Schroeder

*Assistant Examiner*—Andrew M. Falik

*Attorney, Agent, or Firm*—Karl F. Ross

[57] ABSTRACT

A double-lock-stitch sewing machine in which the needle-thread loop on the underside of the workpiece on a stitching plate is engaged with a gripper thread by the rotating gripper associated with the bobbin housing for the bobbin supplying the gripper thread. According to the invention, in the path of the needle-thread loop in the space between the stitch plate and the gripper, there is provided a spring wire or rod which bears upon the needle-thread loop and prevents the formation of knots or bunching in the needle thread. The spring wire is fastened to the underside of the stitch plate on opposite sides of the needle hole and flanks the latter in its undeflected state.

3 Claims, 2 Drawing Figures

FIG.1
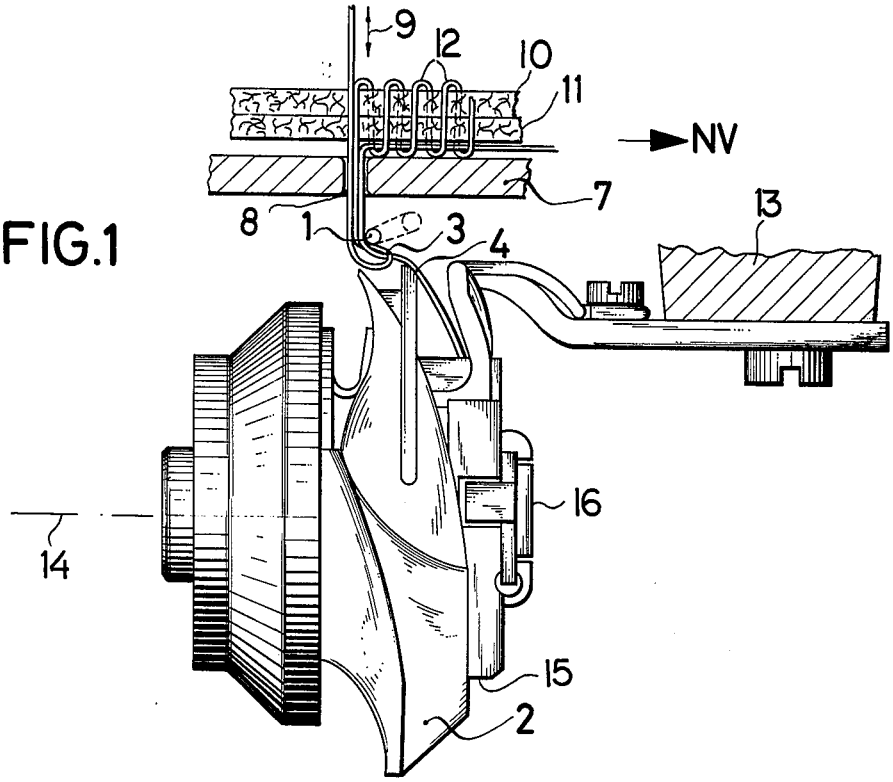
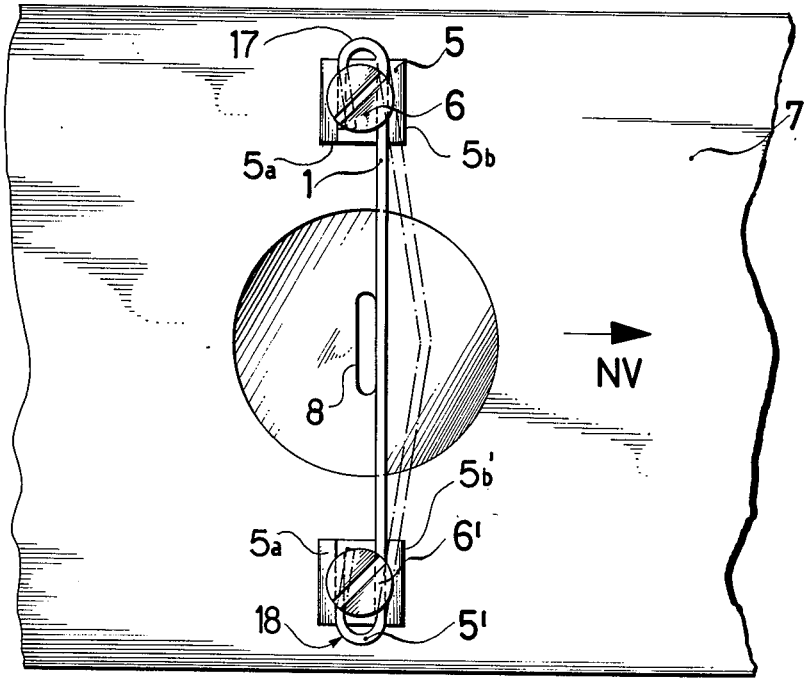
FIG. 2

LOOPER THREAD TENSION DEVICE

FIELD OF THE INVENTION

The present invention relates to a double-lock-stitch sewing machine and, more particularly, to improvements in controlling the movement or pulling of the needle-thread loop in a double-lock-stitch sewing machine.

BACKGROUND OF THE INVENTION

The principles of the formation of double-lock-stitches by sewing machines having a stitch plate through which the needle is thrust from the arm or head of the sewing machine to carry a loop of a needle-thread to the underside of the fabric workpiece or workpieces advanced along the stitch plate below which a bobbin housing for the gripper thread is provided, are well known in the art. Mention may be made of U.S. Pat. Nos. 4,074,645 and 4,137,858 which disclose rotary gripper arrangements, to U.S. patent application Ser. No. 005,781 filed 23 Jan. 1979 in the same field, to the art of record in the files of said patents and application, the German Pat. Nos. 422,546 and 739,559, and to German patent document No. 2741,830 in this connection.

In general, as a workpiece, usually consisting of two or more superposed fabric layers, is advanced across the stitch plate past the sewing head or its arm overhanging the stitching location, the double-lock-stitch is formed by the successive passes of the needle, which carry the needle-thread fed from above the workpiece, to a location below the workpiece at which the needle-thread loop is formed.

Below the workpiece, the needle-thread loop is engaged with a gripper thread fed from a bobbin which is received in a bobbin housing located below the stitch plate.

The present invention is concerned with a system of this type using a rotary gripper, preferably a gripper rotatable about a horizontal axis although the principles hereof are applicable to grippers rotatable about vertical axes or inclined axes as well.

It has long been recognized that the uncontrolled movement of the needle-thread loop below the stitching plate can adversely effect the uniformity of the stitch seam either on the underside alone or on both surfaces at which the stitching may be revealed.

In German Pat. No. 422,546, there is described an arrangement for effecting the movement of the needle-thread loop which consists of a leaf spring fixed to the bobbin-housing mount and which cooperates with a nose or project on the bobbin housing to retard and control the movement of the needle-thread loop during withdrawal of the needle through the hole in the stitch plate and through the fabric workpiece.

In other words the needle-thread loop is retained and briefly clamped with a stressing of the spring. Upon release of the clamping action during withdrawal of the thread, the leaf spring is impelled against the tighter loop drawn along the underside of the fabric. This can eliminate, for the most part, the formation of knots and bunches along the underside of the seam which can result when the movement of the needle-thread loop is uncontrolled. Bunching and knotting in this manner is especially characteristic of the usual highly twisted threads.

A similarly operating spring is described in German patent document No. 27 41 830. In this arrangement, a spring rod stressed at one end functions as a counterpoint for the gripper to receive the needle-thread loop cast off from the gripper point to retard movement of the gripper.

Both of these arrangements have the advantage that they allow the needle-thread loop to be drawn to a relatively small diameter as the stitch formation progresses in a controlled manner, thereby limiting the space or slackness which can form the knots or bunching. In fact, these systems have proven to be highly effective in normal double-lock stitch seaming operations in which the gripper thread and needle-thread loops hook together ultimately at approximately the center of the thickness of the fabric.

When however the needle-thread tension is, relative to the gripper thread tension, somewhat weaker, the more greatly tensioned gripper thread loops around the needle thread and limits the spring of the retaining member which impels this needle-thread loop against the underside of the fabric. This can occur with so-called raised seams when embroidery stitches are to be formed and the embroidered pattern must lie above the surface of the fabric. Similar difficulties are encountered in the sewing of buttonholes for example as described in German Pat. No. 739,559. The earlier spring devices are then ineffective.

OBJECT OF THE INVENTION

It is the object of the present invention to provide a double-lock stitch sewing machine with improved means for controlling the movement of the needle-thread loop whereby the disadvantages of earlier systems are avoided and which is effective for normal double-lock stitch operations as well as the operations in which the needle-thread tension is markedly less than the gripper thread tension.

SUMMARY OF THE INVENTION

This object and others which will become apparent hereinafter are attained, in accordance with the invention in a double-lock stitch sewing machine of the aforedescribed type in which a rotary gripper orbits around a bobbin housing below the stitch plate and in which the bobbin for the gripper thread is received in this housing. According to the invention, the device for controlling the movement of the needle-thread loop during the tightening of the stitch and withdrawal of the needle-thread upon retraction of the needle comprises a spring rod which is disposed in the path of movement of the needle-thread loop in the space between the stitch plate and the gripper for briefly retaining the loop.

According to a feature of the invention, two clamping screws disposed on opposite sides of the stitch location engage bent ends of the spring rod and hold these ends in respective plates or brackets so that the center of the spring rod is normally positioned directly adjacent the needle hole and upon engagement with the gripper-thread loop. Advantageously the spring rod lies transverse to the fabric feed direction and is bendable in this direction.

BRIEF DESCRIPTION OF THE DRAWING

The above and other objects, features and advantages of the present invention will become more readily apparent from the following description, reference being made to the accompanying drawing in which:

FIG. 1 is a side elevational view of the gripper of a double-lock-stitch sewing machine according to the invention, the view being taken in section through the stitching plate and through the fabric layers forming the workpiece and through the spring rod of the present invention; and FIG. 2 is a bottom view of the stitch plate showing the spring rod and the means for fastening it in place on the underside of the stitch plate.

SPECIFIC DESCRIPTION

FIG. 1 shows a portion of a double-lock-stitch sewing machine according to the invention in which the stitch plate 7 is formed with the stitching hole through which a needle is vertically reciprocable in the direction of an arrow 9 by the usual head system (not shown) of the sewing machine overhanging the stitch plate. The workpiece is here represented by two superposed fabric layers 10 and 11 which have been traversed by previous double-lock stitches 12 as the workpiece is moved in the fabric advance direction NV.

The machine housing 13 also carries a rotary gripper 2 of conventional design, the gripper being rotatable about a horizontal axis 14 by the usual drive system and comprising a bobbin housing 15 with its cover 16 and in which the bobbin (not shown) is received.

The needle-thread loop 3, after it is slung around the gripper thread 4 upon rotary entrainment of the loop by the gripper 2 and the usual points thereon (see the aforementioned patents, application and publication) is drawn upwardly by a conventional thread lever in the withdrawal phase and is carried upwardly with the gripper thread 4 delivered by the bobbin until the loop is engaged by the spring rod of the invention which has been represented by the dot-dash line in FIG. 1.

The opposite ends 17 and 18 of the resilient rod 1 are bent into U-shape bights with the shanks thereof lying between flanges 5*a* and 5*b* or 5*a*′ and 5*b*′ of a pair of spacing blocks 5 and 5′ secured by the screws 6 and 6′ to the underside of the stitch plate 7. The blocks 5 can pivot about the axis of the respective screws to allow the center of the bar 1 to be deflected in the direction NV are represented by the dot-dash line in FIG. 2. Normally, as shown by solid line in FIG. 2, the bar lies directly adjacent the stitch hole 8.

The deflection of the resilient rod is effected when the needle-thread-loop 3, during its upward movement after disengagement from the gripper 2 reaches the rod 1 and carries the gripper thread 4 which is more strongly tensioned than the needle-thread, into contact with the bar 1 (solid lines in FIG. 1).

There is thus a brief retardation of the lowermost bight portion of the needle-thread loop below the spring rod 1.

Further upward movement of the needle-thread stretches the needle-thread loop and pulls the region at which the latter engages the gripper thread 4 along and past the dot-dash line position.

This portion then passes the plane of movement of the rod 1 so that the latter springs back into its original or normal position. The bight of the needle-thread loop, over a very short pass, then rises to the underside of the fabric and lies there so that the region in which the needle and gripper threads are looped one about the other, can remain on the underside of the thread for the formation of a so-called raised seam in a clean unbunched manner.

The extremely short path between this disengagement from the spring rod on the underside of the stitch plate to the underside of the fabric minimizes uncontrolled movement of the needle-thread loop.

Naturally, the invention is not limited to the embodiment illustrated and it is possible to provide the spring rod parallel to the stitch plate but transverse to the direction of fabric feed NV so that it is stressed and held only at one end. Furthermore the system can be used for grippers rotatable about vertical axes as well. The thread retaining rod 1 has been found to be useful for the formation of seams with a wide range of thread tension ratios and for convention double-lock stitch seaming as well as for the formation of raised seams in the manner described.

I claim:

1. In a double-lock stitch sewing machine having a stitch plate provided with a needle hole into which a needle carries a needle-thread from above the stitch plate through a workpiece on the stitch plate to form a needle-thread loop below the stitch plate, a gripper is rotatable about the axis of a bobbin housing to engage said loop with a gripper thread drawn from a bobbin in said housing, and the needle-thread loop is drawn upwardly through said stitch plate, the improvement which comprises a spring rod mounted between said stitch plate and said gripper in the path of the loop and the portion of the gripper thread engaged therewith for briefly retarding the upward movement of said loop, said rod being deflectable by said loop at said portion, said rod being formed at each end with a respective bight, each of said bights being retained in a clamping block against the underside of said stitch plate by a respective screw.

2. The improvement defined in claim 1 wherein said rod is straight in an undeflected condition of said rod and lies adjacent said hole.

3. The improvement defined in claim 1 wherein said rod extends transversely to the direction of sewing.

* * * * *